United States Patent [19]

Pearson et al.

[11] Patent Number: 4,840,254

[45] Date of Patent: Jun. 20, 1989

[54] ELEVATOR HOISTWAY DOOR INTERLOCK

[75] Inventors: David B. Pearson, Raritan; Robert A. Wissell, Maywood, both of N.J.

[73] Assignee: Westinghouse Electric Corp., Pittsburgh, Pa.

[21] Appl. No.: 231,407

[22] Filed: Aug. 12, 1988

[51] Int. Cl.[4] ..... B66B 13/00

[52] U.S. Cl. ..... 187/57; 187/61; 200/61.71

[58] Field of Search ..... 187/51, 57, 61, 31, 187/52 LC; 200/410, 412, 61.58 R, 61.62, 61.64, 61.65, 61.74, 61.71; 49/116, 31

[56] References Cited

U.S. PATENT DOCUMENTS 2,307,542 11/1943 Prince ..... 187/61

FOREIGN PATENT DOCUMENTS 1153293 3/1958 France ..... 200/410

*Primary Examiner*—Joseph J. Rolla
*Assistant Examiner*—Kenneth Noland
*Attorney, Agent, or Firm*—D. R. Lackey

[57] ABSTRACT

An electro-mechanical elevator hoistway door interlock which includes an electrical switch mounted adjacent to a hoistway door jamb having a pair of spaced pivotable contact actuatable from first to second positions by a bridging contact carrier by the associated hatch door. The bridging contact pivots the spaced pivotable contacts in opposite rotational directions as they are actuated between the two positions, providing a contact wiping action during each engagement and disengagement. Springs bias the pivotable contacts towards their first positions, and carry current in an active electrical circuit when the pair of spaced pivotable contacts are actuated by the bridging contact.

5 Claims, 3 Drawing Sheets

FIG. 4
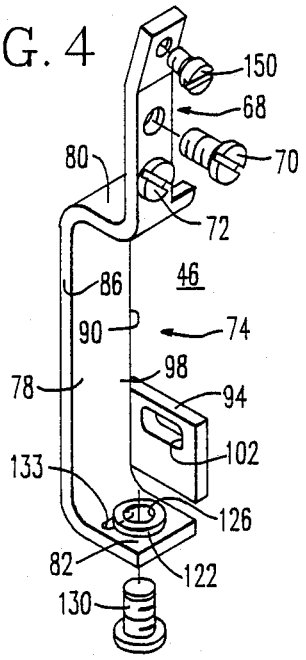
FIG. 3
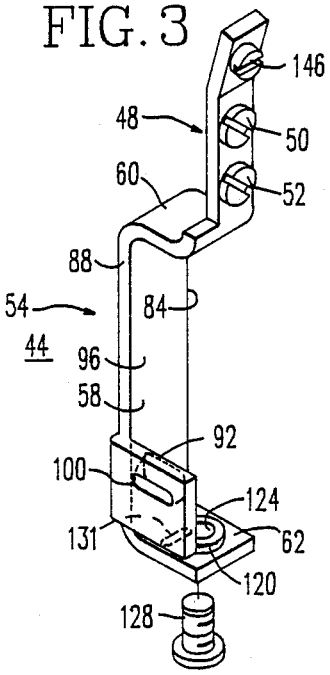
FIG. 6
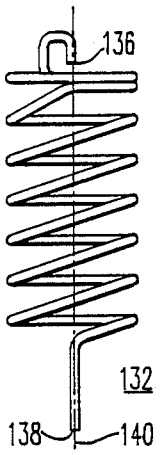
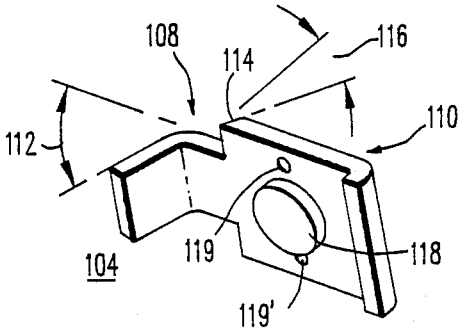
FIG. 5

ELEVATOR HOISTWAY DOOR INTERLOCK

TECHNICAL FIELD

The invention relates to elevator hoistway doors, and specifically to electro-mechanical elevator hoistway door interlocks.

BACKGROUND ART

Hoistway door interlocks are required to prevent an elevator car from being operated by its motive means until the hoistway door at the position of the elevator car is locked in the closed position. The interlock, after the car leaves the position of the hoistway door, then prevents the hoistway door from being opened from the landing side by unauthorized personnel, until the elevator car is again within the landing zone of the floor and is either stopped or being stopped. When the hoistway door moves to the closed position, the hoistway door is mechanically locked, and after the mechanical lock is made, an electrical indication is provided for the elevator drive control which enables the associated motive means to operate the car.

The hoistway door interlock, since it is subject to mechanical and electrical actuation every time the elevator car stops at the associated floor, should be rugged and reliable, it should require no lubrication, and it should have the ability to provide an electrical indication after the hoistway doors are locked even when the electrical components which must cooperate are misaligned. If the electrical indication is not given after the hoistway doors are properly locked, the car will not move away from the floor and elevator service by this car is terminated until service personnel can be called to correct the problem. Thus, it is the object of the present invention to improve the electrical switch which provides the electrical indication after proper mechanical locking of the hoistway door, to strive to achieve the desirable reliable, maintenance-free aspects.

DISCLOSURE OF THE INVENTION

Briefly, the present invention improves upon the electrical switch of the hoistway door interlock by providing an electrical switch, mounted on the hoistway door jamb, having first and second elongated stationary electrical contacts which have upper portions fixed to an insulative block and lower portions which depend from the insulative block. The lower portions are configured to enable a bridging electrical contact carried by the hoistway door to be moved into the electrical switch by the closing movement of the hoistway door, and to thereafter actuate the switch by a downward movement of the bridging contact after the hoistway door is mechanically locked, using a continuation of the same mechanical motion which locked the hoistway door to move the bridging contact, all without critical alignment requirements.

The configuration of the lower portions of the first and second stationary contacts is substantially U-shaped in side elevation, having an upper leg which integrally joins the associated upper portion of the stationary contact, a lower leg having an upwardly facing spring seat, and a connecting bight. The bights of the first and second stationary contacts each include an outwardly extending arm disposed on the edges of the bights which are not adjacent to one another, with the arms defining slots which carry pivotable contacts having downwardly facing spring seats. Springs are disposed between the spring seats of the leg and pivotable contacts, which bias the pivotable contacts to first positions. The pivotable contacts are simultaneously pivotable in opposite rotational directions to second positions, against the bias of the springs, by the downward movement of the bridging contact which occurs after the hoistway doors are mechanically locked in a closed position, accommodating misalignment while assuring a good wiping action between the pivotable contacts and the bridging contact upon each engagement and disengagement thereof. The springs are made an active part of an electrical circuit which is established when the pivotable contacts are actuated by the bridging contact, with the springs paralleling the joints formed between the pivotable contacts and the slots defined by the associated support arms.

BRIEF DESCRIPTION OF THE DRAWINGS

The invention will become more apparent by reading the following detailed description in conjunction with the drawings, which are shown by way of example only, wherein:

FIG. 3 is a perspective view of a left-hand stationary contact used in the interlock shown in FIGS. 1 and 2;

FIG. 4 is a perspective view of a right-hand stationary contact used in the interlock shown in FIGS. 1 and 2;

FIG. 5 is a perspective view of a pivotable contact used in the interlock shown in FIGS. 1 and 2;

FIG. 6 is an elevational view of a spring used in the interlock shown in FIGS. 1 and 2;

DESCRIPTION OF PREFERRED EMBODIMENTS

Figure 1:
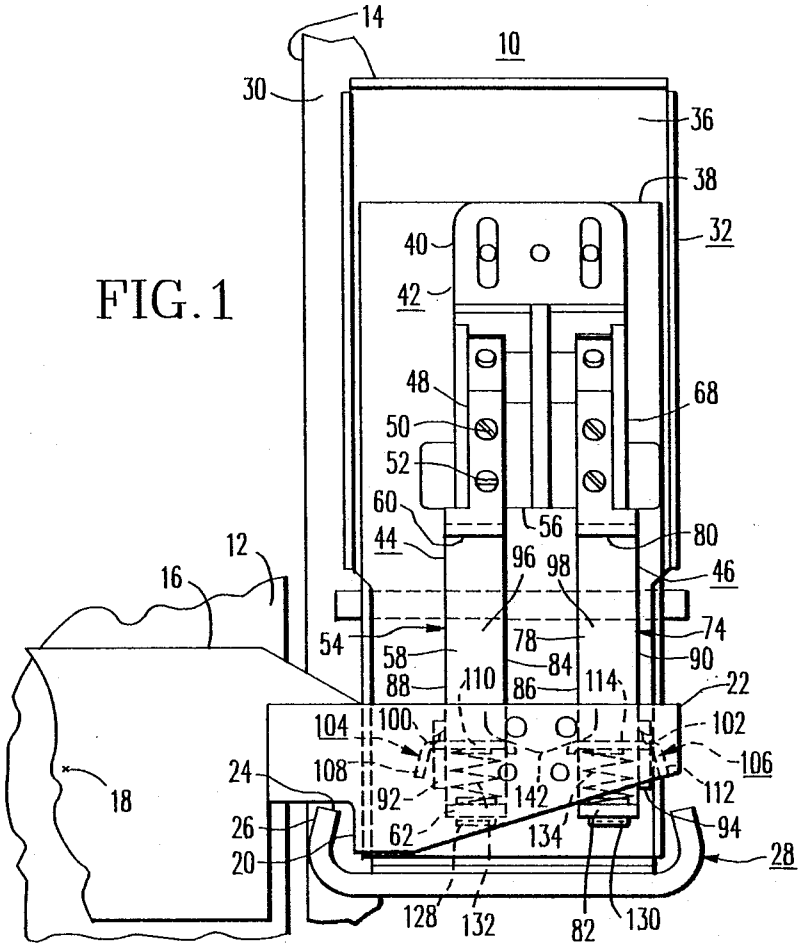
FIG. 1 is a front elevational view of a hoistway door interlock constructed according to the teachings of the invention, with some parts broken way and some shown in phantom.

Referring now to the drawings, and to FIG. 1 in particular, there is shown a hoistway door interlock 10 associated with a hoistway door 12 and a hoistway door jamb 14, which interlock is constructed according to the teachings of the invention. As is well known in the elevator art, a drive vane on an elevator car door engages drive blocks (not shown) on the hoistway side of hoistway door 12 to open the hoistway door 12 when the elevator car door opens. The initial opening movement of the elevator car door is translated to a pivotable movement of a heavy metallic arm 16 carried by the hoistway door 12, with the pivotable movement being counter clockwise about a pivot axis shown generally at 18. This movement lifts a leg 20 of an insulative nose member 22 carried by arm 16 above the upper edge 24 of a lip 26 which is part of a bracket 28 which is fixed on a hoistway wall 30 immediately adjacent to hoistway door jamb 14. The hoistway door 12 is mechanically unlocked by this action, and continued movement of the elevator car door will move the hoistway door with it due to the interengaged door vane and drive blocks.

When the car door moves the hoistway door 12 to the closed position, the force holding arm 16 upwardly is removed, and the heavy arm 16 pivots clockwise by gravity. Leg 20 thus moves downwardly into a position relative to lip 26 of bracket 28 which prevents hoistway door 12 from being opened.

Figure 7:
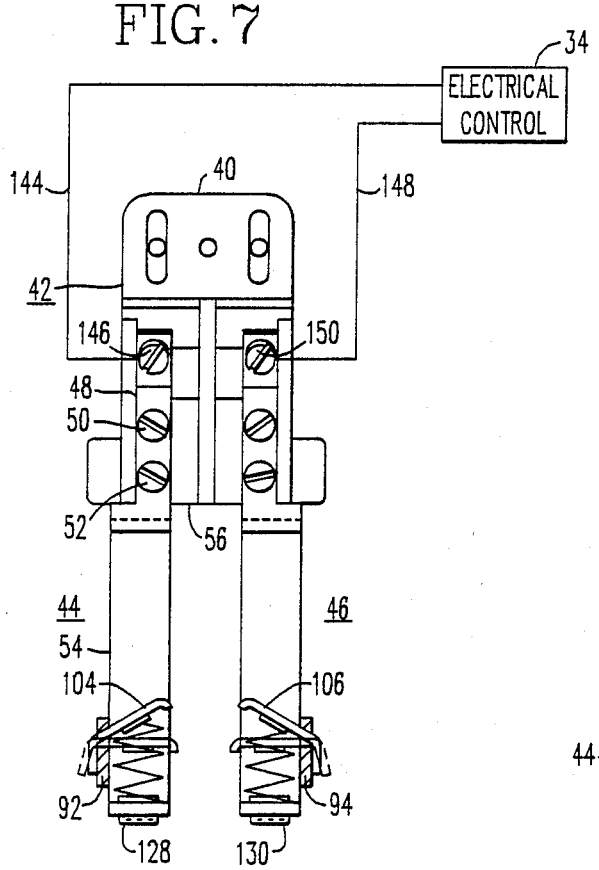
FIG. 7 is a front elevational view of the stationary electrical contact structure of the hoistway door interlock shown in FIGS. 1 and 2, without the movable bridging contact, illustrating the unactuated configuration of the contact structure in solid and the actuated configuration in phantom.

An electrical switch 32 is associated with bracket 28, such that after the mechanical locking or latching of the hoistway door 12, an electrical indication is provided for elevator control, shown generally at 34 in FIG. 7. After the electrical indication is received, the control 34 is enabled to provide a start signal for the elevator car motive means, such as a traction drive machine or a hydraulic jack. The present invention is related to the construction of electrical switch 32.

More specifically, electrical switch 32 includes a metallic mounting base 36, with a sheet of electrically insulative material 38 being fixed to base 36. A stationary electrical contact structure 42 is fixed to insulative sheet 38 and to base 36, with contact structure 42 including an electrically insulative mounting block 40 disposed on insulative sheet 38, and first and second horizontally spaced elongated metallic contacts 44 and 46, respectively.

The first elongated metallic contact 44, as best shown in FIG. 3, includes an upper portion 48 which is fixed to insulative mounting block 40, such as by screws 50 and 52, and a lower portion 54 which extends downwardly from, i.e., depends from, the insulative mounting block 40, extending well below the lower surface 56 of block 40. The lower portion 54 of the first stationary electrical contact 44 has a substantially U-shaped configuration in side elevation, including a bight 58 and upper and lower leg portions 60 and 62, respectively. The upper leg portion 60 is integrally joined to the upper portion 48 of the first metallic contact 44.

In like manner, the second elongated metallic contact 46, as best shown in FIG. 4, includes an upper portion 68 which is fixed to insulative mounting block 40, such as by screws 70 and 72, and a lower portion 74 which extends downwardly from the insulative mounting block 40. The lower portion 74 of the second stationary electrical contact 46 has a substantially U-shaped configuration in side elevation, including a bight 78 and upper and lower leg portions 80 and 82, respectively. The upper leg portion 80 is integrally joined to the upper portion 68 of the second metallic contact 46.

Bights 58 and 78 have inner edges 84 and 86, respectively, disposed in adjacent spaced relation, and outer, non-adjacent edges, 88 and 90, respectively. The outer, non-adjacent edges 88 and 90 include outwardly extending arms 92 and 94, respectively. Arms 92 and 94 may be integrally formed flat with the associated bight, and then subsequently bent outwardly to form an angle of 90 degrees relative to the flat outermost surfaces 96 and 98 of bights 58 and 78.

Arms 92 and 94 define elongated slots 100 and 102, respectively, which are in horizontal alignment with one another. The elongated dimension of slots 100 and 102 extends perpendicularly outward relative to the plane of the insulative sheet 38. Slots 100 and 102 have a greater height dimension at the inner surfaces of arms 92 and 94, i.e., those surfaces of arms 92 and 94 which face one another, than at the outer surfaces, to allow a predetermined pivotable movement of pivotable contacts which will be disposed in slots 100 and 102.

First and second pivotable contacts 104 and 106 are respectively disposed in slots 100 and 102. The first and second pivotable contacts 104 and 106 are of like construction, and thus only pivotable contact 104 will be described in detail. As best shown in FIG. 5, the first pivotable contact 104 includes first and second portions 108 and 110, respectively, disposed on opposite sides of arm 92, with the first portion 108 being bent downwardly relative to the second portion 110, such that it makes an angle 112 of about 75 degrees relative to a horizontal plane disposed through the second portion 110. Thus, pivotable contact 104 is free to pivot counterclockwise, with reference to FIG. 1, for about 15 degrees from a horizontal orientation, at which point the first portion 108 contacts arm 92 to provide a first positive stop or limit for the first pivotable contact 104. A shoulder 114 where the second portion 110 is immediately adjacent to arm 92 is provided with an angle 116 from the vertical of about 15 degrees, which, along with the changing height of slots 100 and 102, accommodate pivotable movement of contacts 104 and 106. The downwardly facing surface of the second portion 110 of contact 104 includes a spring seat 118, and openings 119 and 119' are provided through the second portion 110.

The second pivotable contact 106, which as hereinbefore stated may be constructed the same as the first pivotable contact 104, is free to pivot clockwise, with reference to FIG. 1, for about 15 degrees from a horizontal orientation, at which point the first portion 108 contacts arm 94 to provide a first positive stop or limit for the second pivotable contact 106.

Referring again to FIGS. 3 and 4, the lower legs 62 and 82 of the first and second electrical contacts 44 and 46 include spring seats 120 and 122, respectively, on their upwardly facing surfaces. Tapped openings 124 and 126 are provided through legs 62 and 82, with the tapped openings 124 and 126 also extending through the spring seats 120 and 122. The tapped openings 120 and 122 receive screws 128 and 130, each of which provides dual functions, as will be hereinafter explained. Openings 131 and 133 are provided through legs 62 and 82, respectively.

First and second compression springs 132 and 134 are disposed to bias pivotable contacts 104 and 106 counterclockwise and clockwise, respectively. When the bias is unopposed, contacts 104 and 106 are biased by springs 132 and 134 to their first positions, shown in solid in FIG. 7. Spring 132 is supported between spring seat 118 of the first pivotable contact 104 and spring seat 120 of contact 44. Spring 134 is supported between spring seat 118 of the second pivotable contact 106 and spring seat 122 of contact 46. Springs 132 and 134 may be of like construction, and thus only spring 132 will be described in detail.

FIG. 6 is an elevational view of spring 132. Spring 132, which includes a plurality of turns, such as four to five, has upper and lower ends 136 and 138. The upper end 136 is bent to form an inverted U-shape. The lower end is bent during assembly, as will be hereinafter explained.

Figure 8:
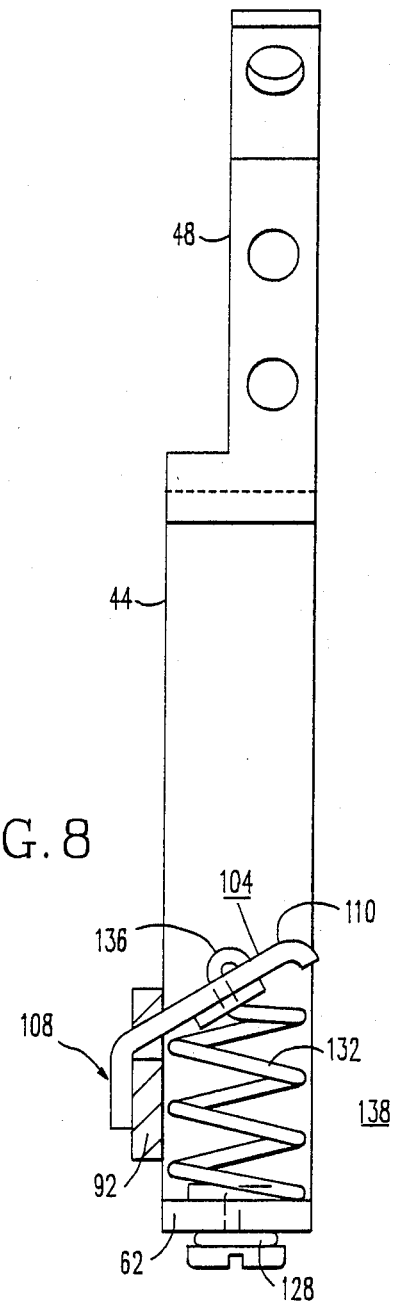
FIG. 8 illustrates one of the stationary contacts of the electrical contact structure of FIG. 3, illustrating connection of a spring into an electrical circuit, according to the teachings of the invention.

Pivotable contacts 104 and 106 are assembled with stationary contacts 44 and 46, respectively, in like manner, and thus only the assembly of pivotable contact 104 with stationary contact 44 will be described in detail As best shown in FIG. 8, end 136 of spring 132 is inserted through opening 119 in pivotable contact 104 with the upper opening of spring 132 disposed in the desired position relative to spring seat 118. End 136 is then swaged or crimped in the opening 119 to provide a low electrical resistance metallurgical joint or bond between spring 132 and the pivotable contact 104. The depending "tail" 108 of contact 104 is then inserted through slot 100. The lower opening of spring 132 is then properly positioned relative to the lower spring seat 120, with the lower end 138 being inserted through opening 131 in the lower leg 62. Screw 128 is then threadably engaged with tapped opening 124 and end 138 of spring 132 is bent around screw 128 and then tightly clamped between the lower surface of lower leg 62 and the head of screw 128. Screw 128 has a dimension selected such that it functions to define a second stop or pivotable limit, preventing pivotable contact 104 from being pivoted clockwise beyond the point where pivotable contact 104 makes physical contact with the end of screw 128. Thus, screw 128 provides the function of making a good low resistance electrical joint between spring 132 and stationary contact 44, and it provides a limit beyond which the pivotable contact 104 may not be moved. During normal use, pivotable contact 104 will not be actuated to the limit provided by screw 128, but in the event of a misalignment which could result in pivotable contact 104 being urged beyond the location of the second stop, screw 128 will prevent such additional movement.

Figure 2:
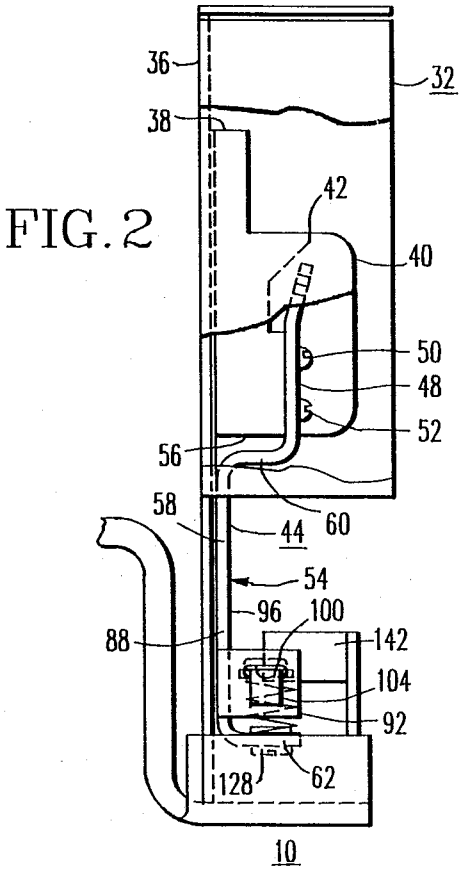
FIG. 2 is a side elevational view of the hoistway door interlock shown in FIG. 1.

As shown in FIGS. 1 and 2, the insulative nose 22 carried by metallic arm 16 provides support for a metallic bridging contact 142. When the hoistway door 12 reaches its closed position, allowing arm 16 to pivot downwardly, bridging contact 142 engages both pivotable contacts 104 and 106, pivoting them in opposite circumferential directions, from the solid line positions shown in FIG. 7 to the phantom positions, also shown in FIG. 7. When the arm 16, insulative nose 22, and bracket 28 which holds switch 32 are all properly aligned, insulative nose 22 will contact end 24 of bracket leg 26 and terminate the actuation of the pivotable contacts 104 and 106 when they have been pivoted about fifteen degrees to a horizontal position, well before the second limit or stop defined by screws 128 and 130.

Electrical contact 44 is connected to control 34 via a wire 144 and a screw 146, and electrical contact 46 is connected to control 34 via a wire 148 and a screw 150. Thus, when the hoistway door 12 is mechanically locked in the closed position by bracket 28 and arm 16 pivots downwardly, bridging contact 142 actuates both pivotable contacts 104 and 106 with a contact cleaning or wiping action by virtue of the fifteen degree pivot which accommodates misalignment while providing a desired oxide prohibiting wiping action between bridging contact 142 and the pivotable contacts. The bridging contact thus completes an electrical circuit which extends from control 34, wire 144, screw 146, stationary contact 44, the joint between leg 62 of contact 44 and end 138 of spring 132, the spring 132, the metallurgical joint between end 136 of spring 132 and pivotable contact 104, the tightly biased joint between contact 104 and the bridging contact 142, the tightly biased joint between bridging contact 142 and pivotable contact 106, and a circuit from pivotable contact 106 back to control 34 which is similar to the circuit just described relative to stationary contact 44, which circuit includes spring 134. Thus, the good electrical circuits established through springs 132 and 134 parallel the higher resistance pivotable joints between arms 92 and 94 and the pivotable contacts 104 and 106, always assuring that a good electrical indication is provided for control 34 after the hoistway door 12 has been mechanically locked. The hoistway door interlock 10 is self cleaning, always wiping the contact surfaces between the bridging contact 142 and the pivotable contacts upon each engagement, further adding to the reliability of the interlock. The screws 128 and 130 prevent unduly distorting the springs 132 and 134, should misalignment occur which would attempt movement of the pivotable contacts 104 and 106 beyond predetermined positions by the bridging contact 142.

We claim:

1. In an electro-mechanical elevator hoistway door interlock which mechanically latches an elevator hoistway door in a closed position and provides an electrical indication when the mechanical latch is made, including a first latch portion carried by a hoistway door, a bridging contact carried by the first latch portion, a second latch portion fixed to a hoistway door jamb which is cooperable with the first latch portion to prevent unauthorized opening of the hoistway door when it is closed, and an electrical switch associated with the second latch portion which is actuated by the bridging contact to provide the electrical indication when the hoistway door is closed and latched by the first and second latch portions, an improvement to the electrical switch comprising:

an insulative mounting block, first and second elongated stationary electrical contacts, each of said first and second stationary electrical contacts having an upper portion fixed to said insulative mounting block and a lower portion depending from said insulative mounting block, the lower portion of each of said first and second electrical contacts having a substantially U-shaped configuration in side elevation, including a bight and upper and lower legs, the bights of said first and second electrical contacts having inner edges in adjacent spaced relation, and outer non-adjacent edges, the upper leg of each of said first and second electrical contacts being integrally joined to the upper portion of the associated stationary electrical contact, the lower leg of each of said first and second electrical contacts having an upwardly facing spring seat, the bights of said first and second electrical contacts each having an outwardly extending arm on said outer non-adjacent edges, the arm of each of said first and second electrical contacts defining a slot, a pivotable contact disposed in the slot of each of said first and second electrical contacts, with said pivotable contact having a downwardly facing spring seat, and a spring disposed to extend between the spring seats of the lower leg and pivotable contact of each of said first and second electrical contacts, said springs biasing said pivotable contacts to first positions, the pivotable contacts of said first and second electrical contacts being simultaneously pivotable in opposite rotational directions to second positions, against the bias of said springs, by a downward movement of the bridging contact, providing a wiping action between the pivotable contacts and the bridging contact.

2. The hoistway door interlock of claim 1 wherein each pivotable contact includes first and second portions disposed on opposite sides of the associated arm, with the first portion carrying the spring seat and the second portion cooperating with the associated arm to provide a limit which defines the first position of the pivotable contact.

3. The hoistway door interlock of claim 1 wherein the spring seat on each leg portion surrounds a tapped opening, and including a screw disposed in the tapped opening of each of the first and a second electrical contacts which extends towards the associated pivotable contact by a dimension which establishes a predetermined limit on the downward movement of the associated pivotable contact.

4. The hoistway door interlock of claim 1 wherein the spring seat on each leg portion surrounds a tapped opening, and including a screw disposed in the tapped opening of each of the first and second electrical contacts, and wherein each spring has upper and lower ends, with the lower end being captured between the associated screw and leg, and with the upper end being bonded to the associated pivotable contact, to provide a low resistance electrical circuit from the upper portion of each of the first and second electrical contacts to the associated pivotable contact.

5. The hoistway door interlock of claim 1 wherein the second latch portion includes a bracket having an upwardly extending lip, the first latch portion defines a U-shaped portion having a bight and a depending leg portion which moves downwardly into an interference position with said lip when the hatch door is closed, with said bight contacting the lip to establish a limit for the bridging contact which defines the second positions of the pivotable contacts.

* * * * *